US005115871A

United States Patent [19]

McCann et al.

[11] Patent Number: 5,115,871

[45] Date of Patent: May 26, 1992

[54] METHOD FOR THE ESTIMATION OF PORE PRESSURE WITHIN A SUBTERRANEAN FORMATION

[75] Inventors: Dominic P. J. McCann, Paris; Yves Kerbart, Gentilly, both of France; Trevor M. Burgess, Missouri City, Tex.

[73] Assignee: Schlumberger Technology Corporation, Houston, Tex.

[21] Appl. No.: 664,261

[22] Filed: Mar. 4, 1991

[30] Foreign Application Priority Data

Dec. 3, 1990 [FR] France ..... 90 03230

[51] Int. Cl.[5] ..... E21B 49/00

[52] U.S. Cl. ..... 175/50; 175/65; 73/151

[58] Field of Search ..... 175/38, 40, 48, 50, 175/57, 65, 72; 73/151, 151.5, 155

[56] References Cited

U.S. PATENT DOCUMENTS

| | | | |
|---|---|---|---|
| 3,646,808 | 3/1972 | Leonard | 73/155 |
| 3,729,986 | 5/1973 | Leonard | 73/155 |
| 3,866,468 | 2/1975 | Smith et al. | 175/27 |
| 3,942,594 | 3/1976 | Smith et al. | 73/151 |
| 4,553,429 | 11/1985 | Evans et al. | 73/155 |
| 4,570,480 | 2/1986 | Fontenot et al. | 73/155 |
| 4,748,563 | 5/1988 | Anthoine | 364/420 |
| 4,852,665 | 8/1989 | Peltier et al. | 175/40 |
| 4,980,642 | 12/1990 | Rodney | 73/153 X |

FOREIGN PATENT DOCUMENTS

| | | |
|---|---|---|
| 2032981 | 5/1980 | United Kingdom . |
| 2156402 | 10/1985 | United Kingdom . |

OTHER PUBLICATIONS

Manohar Lal, "Surge and Swab Modeling for Dynamic Pressures and Safe Trip Velocities", IADC/SPE 11412.

*Primary Examiner*—Terry Lee Melius

*Attorney, Agent, or Firm*—Martin Hyden; John J. Ryberg

[57] ABSTRACT

A method for the estimation of pore pressure within a subterranean formation containing fluid during the drilling of a bore hole. The bore hole is drilled using a drill string consisting of a drill bit fitted to its lower end, and using drilling mud pumped from the surface through the drill string and finally evacuated. The method is characterized by, while the drill bit is level with the formation and while the drill string is being raised to the surface for a distance at least equalling the drill pipe length, a) the monitoring of the change in value of an initial parameter such as mud level in a mud tank to detect the influx of the fluid from the formation into the bore hole;

b) the monitoring of the change in value of a second parameter such as the apparent drill string weight whereby the second parameter characterizes the force applied at the surface to retrieve the drill string;

(c) the correlation of the values of the first and second parameters in order to detect an increase in one of the parameters, which would correspond to an increase of the other parameter, and then the determination of the increase in value of the second parameter, and d) the estimation of the pore pressure of the formation from the increase in value of the second parameter as determined in step c).

11 Claims, 4 Drawing Sheets

METHOD FOR THE ESTIMATION OF PORE PRESSURE WITHIN A SUBTERRANEAN FORMATION

The present invention relates to a method for the estimation of interstitial pressure within a subterranean formation containing fluid. The method is applied during the drilling of a bore hole through the said formation.

The bore hole is drilled using a drill string comprising a number of drill pipes connected end to end with a drill bit fitted to its lower end, drilling mud being pumped through the said drill string and drill bits back to the surface. The drill string is suspended from the surface using suspension gear such as a hook. Drill pipes are added or removed depending on whether the drill bit is being raised or lowered in the bore hole. To either add or remove pipes, the drill string is periodically wedged in position to allow it to be unhooked from the suspension gear.

When the drill bit needs to be retrieved during drilling (e.g. for replacement because it is worn) the drill string must be extracted and disassembled, element by element (with each element normally composed of a string of three pipes). Then, on recommencing drilling, the drill string is reassembled element by element, lowering the drill bit step by step into the bore hole.

Some subterranean formations are porous, containing fluid such as water, gas, or crude oil within the pores. The fluid within the rock is at a certain pressure termed the pore pressure. When the drill bit of the drill string penetrates such a formation, the fluid tends to flow from the formation into the bore hole for as long as the formation is sufficiently permeable to allow such flow. If the pore pressure is high, the fluid contained in the formation may violently well from the bore hole thus creating a blow-out, which can be extremely dangerous for both the equipment and the drillers if the blow-out is not controlled in time. Drilling fluid, or drilling mud, is therefore used which fills the bore hole and applies a hydrostatic pressure to the bore hole at the level of the formation. The level of hydrostatic pressure depends on the drilling mud density and the depth at which the formation is situated. The drilling mud density is regulated at the surface by modifying its concentration using a weighting agent such as barite so that the hydrostatic pressure is always maintained higher than the pore pressure of the fluid within the formation. The fluid is thus maintained within the formation.

However, the formation must not be damaged and the fluid held within must not be polluted. Thus the drilling mud density must not be too high. In addition, a filtrate reducing agent such as bentonite is added to the drilling mud, forming a relatively impermeable layer, called a mud cake, along the bore hole wall. The cake mainly forms across the porous formations and prevents the drilling mud from penetrating the formations. The mud cake also strengthens the bore hole walls. Thus, the importance of knowing, or at least having a good estimate of, the pore pressures within the formations being drilled or having been drilled is evident.

When raising the drill string within the bore hole towards the surface the drilling mud may be subject to a "piston" effect if the rate of withdrawal is excessive. This effect will lower the drilling mud's hydrostatic pressure within the part of the bore hole below the drill bit and, if this hydrostatic pressure becomes lower than the pore pressure of the fluid contained in a formation, this fluid may enter the bore hole. It is because of this that a bore hole erupts most often when withdrawal of the drill string commences. Conversely, during the drill string's descent within the bore hole, an increase in the hydrostatic pressure is produced. If the descent is too quick, the resulting increase in pressure may cause the formation to fracture. Consequently the drillers control the trip velocities (speeds of descent and ascent) of the drill string so as to prevent any increase or decrease in the hydrostatic pressure. Theoretical models have been developed to determine the optimal speed of descent or ascent of the drill string (considering that time is lost if the rate is too slow) and therefore to determine the change in resultant pressure. The models use different parameters such as the geometry of the bored hole and the drill bit, together with the drilling mud's properties and especially its viscosity. To exemplify this point, one such model is described in article number 11412 of the IADC/SPE, entitled "Surge and Swab modelling for dynamic pressures and safe trip velocities" (1983) by Manohar Lal. These models enable the calculation of the changes in pressure resulting from drill string trips, based on parameters which undergo little or no change during boring. They do not allow the estimation of the pore pressure of a formation from variables measured during boring operations.

Systems have also been invented to control drill string trip velocities. Such systems are described by, for example, patent numbers U.S. Pat. Nos. 3,942,594 or 3,866,468.

Because of its importance, much work has been dedicated to detecting the influx of formation fluid into the bore hole. Without doubt the most widely used method concerns the measurement of the level of drilling mud in the tank in which it is stored after leaving the bore hole, when the drill string is being raised, and before being re-injected into the bore hole. The volume occupied by the drill string materials withdrawn from the bore hole is calculated using reference tables, and added to the volume of drilling mud in the mud tank. The value is compared to previous values and any influx of fluid from the underground formation which may have occurred is thus determined. This operation is carried out regularly after lifting out a drill string stand (usually consisting of 5 to 10 elements, with each element measuring approximately 30 meters). The level of drilling mud in the mud tank may be correlated with another influx indicator such as the flow rate of mud at the bore hole outlet. These techniques may be illustrated using, for example, patent numbers U.S. Pat. Nos. 3,646,808 and 3,729,986, and the request for patent number GB 2,032,981A. However, none of the methods quoted allow an estimation of the pore pressure of the fluid contained within a subterranean formation and using the measurements made during boring which is an object of the present invention.

To achieve this, this invention proposes a method for the estimation of pore pressure within a subterranean formation containing fluid during the drilling of a bore hole through the said formation. The bore hole is drilled using a drill string consisting of a drill bit fitted to its lower end, and using drilling mud pumped from the surface through the said drill string and finally evacuated from the borehole. The method is characterised in that the change in value of an initial parameter is monitored to detect the influx of the said fluid from the formation into the bore hole and the change in value of a second parameter is monitored characterising the force applied at the surface to retrieve the drill string whilst the drill bit is level with the formation and during the raising of the drillstring by a distance at least equal to a drill pipe length, the values of the said first and second parameters are correlated to detect an increase in one of the parameters, which would correspond to an increase of the other parameter, and the increase in value of the second parameter is determined, and the pore pressure of the said formation is estimated from the increase in value of the second parameter as determined.

Conveniently, the first parameter is either the outlet flow rate of the drilling mud or the mud volume within the mud tank on the surface and the second parameter is the apparent weight P of the drill string as suspended from the surface using suspension gear such as a hook.

The change in pressure dp (due to a pistoning effect caused by the drill string being raised) is also conveniently determined, in the bore hole, at the drill bit depth by measuring the increase in apparent weight dP of the drill string when an influx of fluid has been detected at the surface, and using the maximum (sectional) surface area S of a cross-section of the drill bit, according to the formula $dP=dP/S$.

The formation's estimated pore pressure thus lies between the hydrostatic pressure of the drilling mud at the drill bit's depth and the same hydrostatic pressure reduced by the said change in pressure, dp.

The rate of advance of the drill bit is conveniently recorded so as to detect porous formations and then correlated with two other parameters; the volume of drilling mud in the mud tank and the apparent weight of the drill string.

Also, it is useful to record the weight values of the drill bit as a function of depth at least when passing down through the porous formations and when the drill bit is not touching the bottom of the bore hole. The values recorded are then compared with the values measured during the retrieval of the drill string to determine any change in weight.

Other characteristics and advantages of the invention will be given more clearly in the description which follows of one, non-limiting, example of the method, with reference to the accompanying drawing in which.

Figures 3A, 3B:
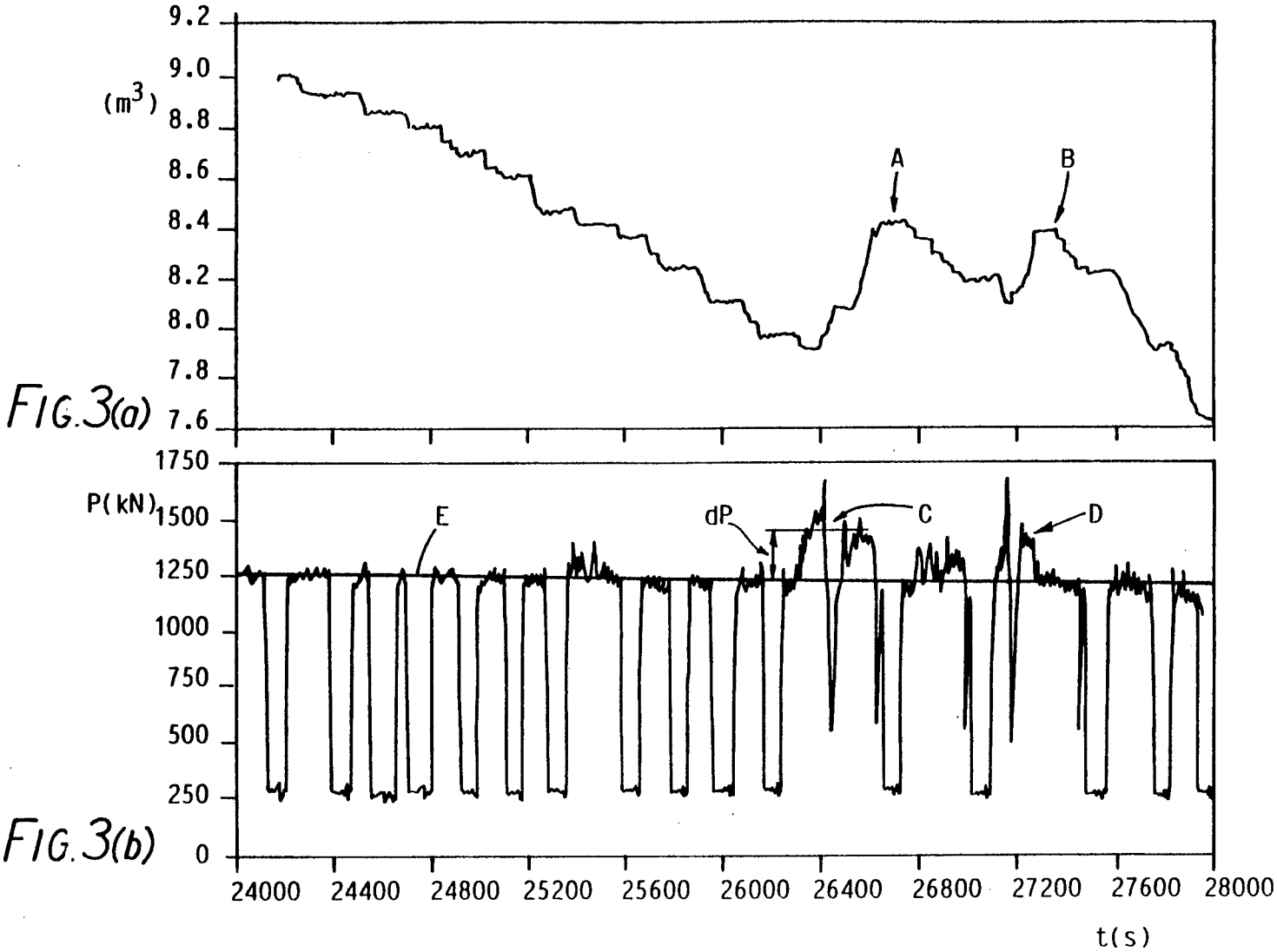

FIGS. 3*a* and 3*b* shows examples of a recording of the apparent weight (in kilonewtons) of the drill string suspended by a hoist hook, with time, and the volume of drilling mud (in cubic meters) in the mud tank.

Figures 4A, 4B:
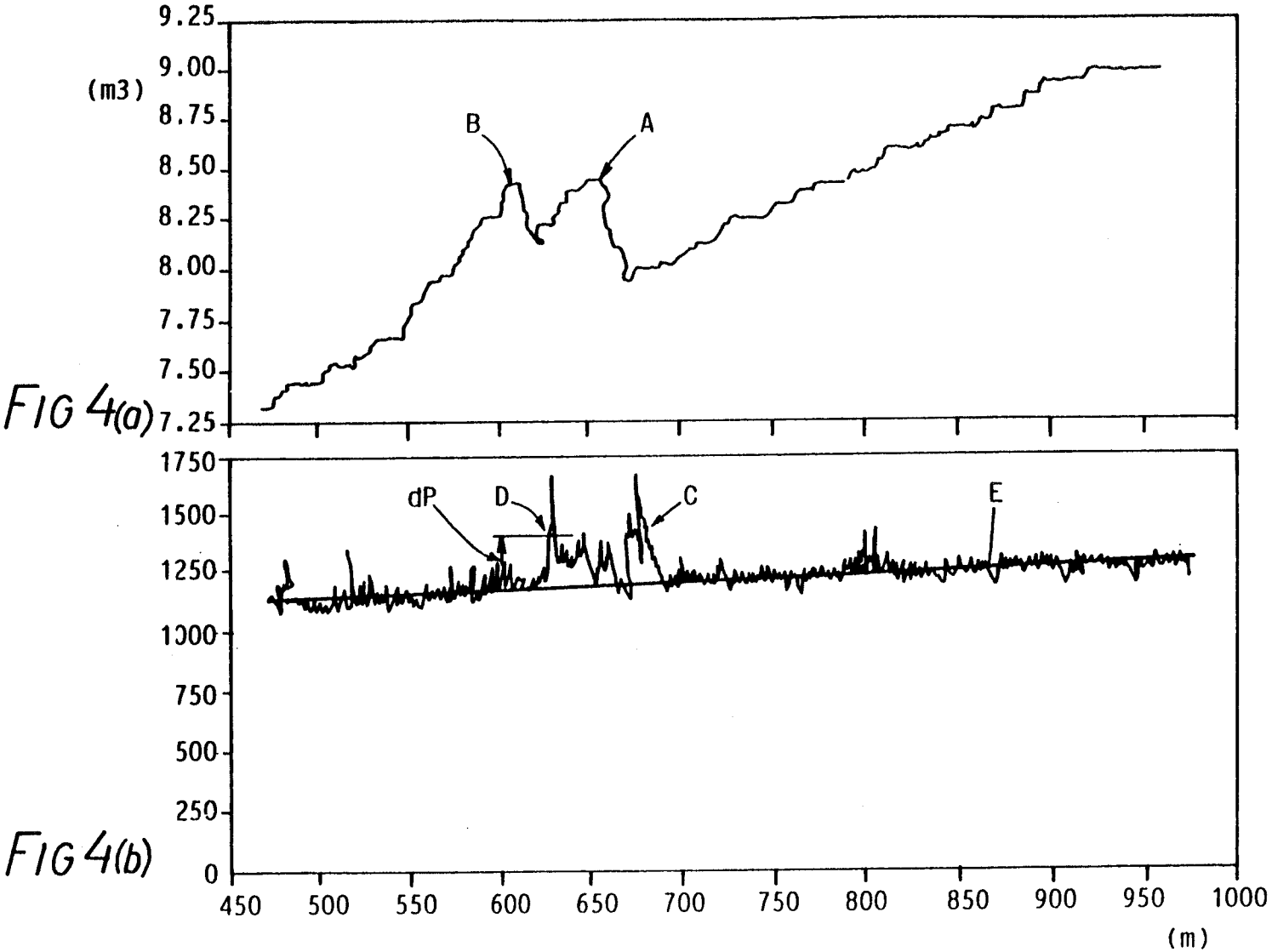

FIGS. 4*a* and 4*b* show the same data records, apparent weight at the hoist hook and the volume of drilling mud in the mud tank, this time corrected for the drill bit depth.

Figure 1:
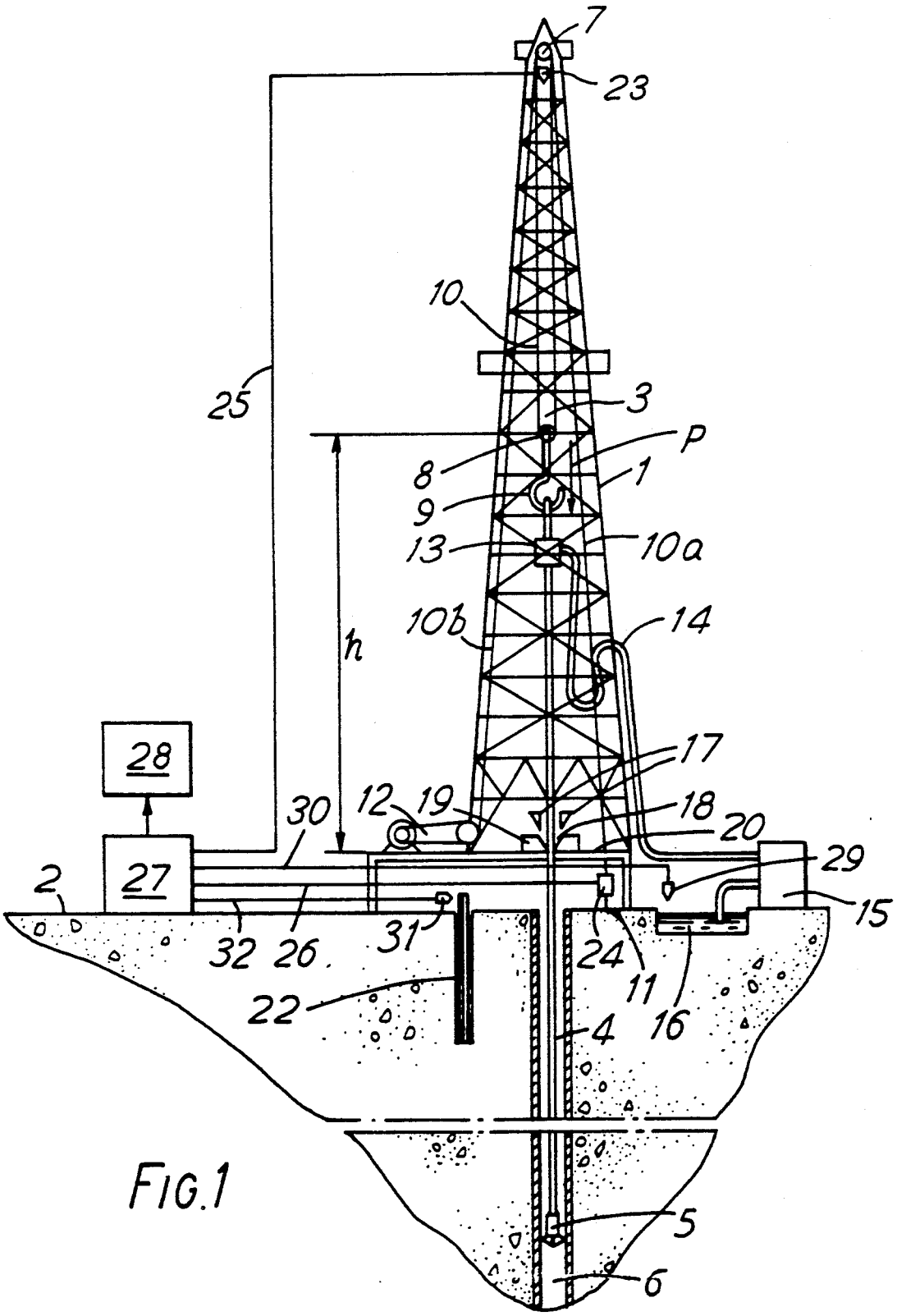
FIG. 1 is a schematic representation of a vertical section of a drilling rig and associated bore hole.

The derrick shown in FIG. 1 comprises of a tower 1 rising above the ground 2 and equipped with a hoist 3 from which the drill string 4 is suspended. The drill string 4 is formed from pipes screwed together end to end and having at its lower end a drill bit 5 to drill the bore hole 6. The hoist 3 consists of a crown block 7 with the axle fixed in position at the top of the tower 1, a lower, vertically free-moving travelling block 8 attached to which is a hook 9, and a cable 10 joining the two blocks 7 and 8 and forming, from the crown block 7 both a fixed cable line 10*a* anchored to a fixed/securing point 11, and a live mobile line 10*b* which winds around the cable drum of a winch 12.

When drilling is not taking place, as shown, the drill string 4 may be suspended from the hook 9 using a rotary swivel 13 connected to a mud pump 15 via a flexible hose 14. The pump 15 is used to inject drilling mud into the bore hole 6, via the hollow drill string 4, from the mud tank 16. The mud tank 16 may also be used to receive excess mud from the bore hole 6. By operating the hoist 3 using the winch 12, the drill string 4 may be lifted, with the pipes being successively withdrawn from the bore hole 6 and unscrewed so as to extract the drill bit 5, or to lower the drill string 4, with the successive screwing together of the tubes making up the drill string 4 and to lower the drill bit 5 to the bottom of the bore hole. These trip operations require the drill string 4 to be unhooked from the hoist 3; the drill string 4 is held by blocking it using wedges 17 inserted in a conical recess 18 within a bed 19 mounted on a platform 20, and through which the pipes pass.

When drilling, the drill string 4 is rotated by a square rod or "kelly" 21 fitted to its upper end. In-between operations, this rod is placed in a sleeve 22 sunk into the ground.

Changes in height h of the travelling block 8 during the lifting operations of the drill string 4 are measured using a sensor 23. In this example it consists of a pivoting angle transmitter coupled to the most rapid spinning pulley within the crown block 7 (i.e. the pulley around which the live line 10*b* is wound). This sensor constantly monitors the rate and direction of rotation of this pulley, from which the value and sense of linear displacement of the cable connecting the two blocks 7 and 8 can be easily determined, thus giving h.

An alternative type of sensor, using laser optics and based on radar principles, may also be used to determine h.

Besides height h, the load applied to the hook 9 of the travelling block 8 is measured; this corresponds to the apparent weight P of the drill string 4, which varies with the number of pipes forming it, the friction experienced by the drill string along the length of the bore hole wall, and the density of the drilling mud. This measurement is obtained using a newton-type force meter 24 inserted in-line on the fixed cable 10*a* of the cable 10 and which measures its tension. By multiplying the value obtained from this sensor by the number of cables connecting block 7 to block 8, the load at the hook of block 8 is obtained.

Sensors 23 and 24 are linked by lines 25 and 26 to a computer 27 which processes the measurement signals and sends them to a recorder 28.

In addition, a sensor 29, linked to the computer 27 via a line 30, measures the level of the drilling mud in the mud tank 16. Sensor 29 consists generally of a float whose displacement is measured, and is both commercially available and presently used on drilling platforms.

A sensor 31 detects the presence or absence of the kelly 21 in the sleeve 22. This sensor is connected to the computer 27 via line 32.

The measurement instruments described above enable the data conversion of the parameters measured with respect to time and the depth of the drill bit 5 in the bore hole 6. One such data conversion is described in patent number U.S. Pat. No. 4,852,665. Most of the drilling platforms also consist of a means of measuring the flow rate of injected drilling mud into the bore hole (usually associated with the pumping means) and the flow rate of the drilling mud leaving the bore hole and returning to the mud tank 16.

Figure 2:
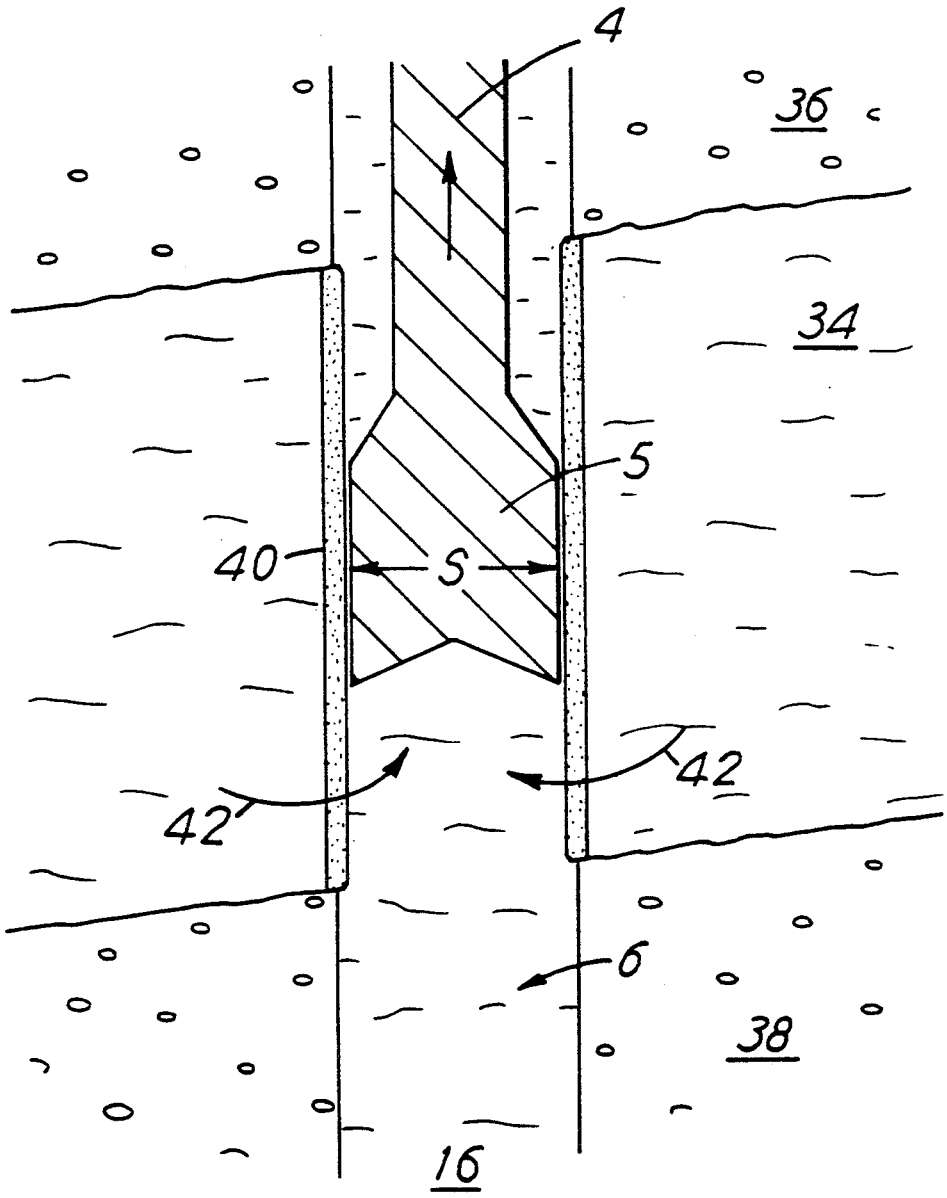
FIG. 2 shows the drill bit passing through a subterranean porous formation.

FIG. 2 is an enlargement of the drill bit 5 fitted to the drill string 4 and being raised in the bore hole 6. The drill bit 5 is seen traversing a porous formation 34, such as sand, containing fluid (a liquid or a gas) under a given pressure called the pore pressure. The formation 34 is surrounded by an impermeable formation 36 above and an impermeable formation 38 below. The drilling mud 16 in contact with the porous formation 34 forms a relatively impermeable mud cake 40 producing a slight protuberance within the bore hole, thus reducing the bore hole diameter. When the drill bit 5 passes through such a porous formation, the reduction in bore hole diameter at this point causes a pistoning effect and therefore a reduction dp in hydrostatic pressure p of the drilling mud just below the drill bit 5. This leads to an influx of formation fluid into the bore hole, as indicated by arrows 42. It may be noted that this fluid influx may also occur even when the drill string is withdrawn very slowly. Also, the inventors have noted that this decrease in pressure dp corresponds with an increase dP of the apparent weight of the drill string (the suspended weight at the hook measured using sensor 24 (FIG. 1)). Using the principle described in this invention, the change in hydrostatic pressure dp is determined by dividing the change in apparent weight dP by the maximum surface area (schematically represented by S in FIG. 2) of the drill bit cross-section perpendicular to the drill bit's longitudinal axis.

$$dp = dP/S$$

When the drill bit does not have a uniform section, the largest cross-sectional area is used.

An increase in apparent weight may not necessarily correspond to the piston phenomenon illustrated in FIG. 2, thus, the influx of fluid in the bore hole must be detected, which is accompanied by an increase in mud volume within the mud tank and an increase in mud flow rate leaving the bore hole. An influx of fluid may then be detected by the level detector 29 (FIG. 1) and/or by the flowmeter (not shown) positioned on the drilling mud outlet conduit outside the bore hole. By correlating the values measured for the first parameter and indicating an influx of fluid with the values measured for a second parameter characteristic of the force applied at the surface to lift the drill string, the change in hydrostatic pressure dp at the depth of the drill bit being considered is obtained. The formation's pore pressure producing the fluid may then be estimated as its value lies between the drilling mud hydrostatic pressure and the hydrostatic pressure reduced by the change in pressure dp. Knowing the depth x of the drill bit and the density $\rho$ of the drilling mud, the hydrostatic pressure is given by:

$$p = xg\rho$$

where g is the acceleration due to gravity. If the bore hole is contorted, the depth x must of course be corrected to account for the deviation with respect to the vertical.

For a reasonably thick porous formation 34, the pore pressure may be determined along several drill string stands withdrawn from the bore hole. This may then provide an overall measurement for the stands considered or provide a mean value for the individual measurements obtained for each stand withdrawn. The pore pressure, or more simply the change in apparent weight, may also be determined by averaging the measurements taken during several withdrawals of the drill string.

To measure the changes in apparent weight at the hoist's hook, the reduction or the slope of the successive weight measurements on withdrawing the drill string may be firstly determined. This weight will obviously decrease regularly (stepwise) as the drill string stands of equal lengths are pulled up to the surface. The increase in apparent weight is then measured with respect to this regular decrease in weight. Another, perhaps complementary, method may be used during drilling; for example at each stage when the bore hole is drilled by the length of a drill string rod stand, the drill string may be slightly lifted in order that the drill bit no longer touches the bottom of the bore hole, and the weight at the hook may be measured and recorded when the drill bit is at the level of the formation. The said weight is compared with that previously recorded during drilling when the drill bit was at the same depth in the bore hole.

The measurements of the changes in weight and drilling mud volume within the mud tank may be made and recorded over time, but it would be better if the values were converted with respect to the drill bit depth inside the bore hole. This conversion may be carried out using the method described in patent number U.S. Pat. No. 4,852,665.

Drillers know that the rate of advance of the drill bit during drilling is higher through porous formations than through non-porous formations. Thus it is of interest to map the porous formations during drilling by recording the speed of advancement of the drill bit and by pinpointing the zones where this advancement rate is higher. The method for measuring the rate of advance described in patent number U.S. Pat. No. 4,843,875 may be used in this case. This porous formation depth information may then be correlated with the measurements of the changes in apparent weight and drilling mud volume.

FIGS. 3 and 4 represent the volume of drilling mud in the surface mud tank (FIGS. 3(*a*) and 4(*a*)) measured in cubic meters, and the apparent weight P (in kilonewtons) of the drill string suspended from the hoist hook (FIGS. 3(*b*) and 4(*b*)). The measurements in both FIGS. 3 and 4 are expressed, respectively, with time (in seconds) and depth (in meters) of the drill bit in the bore hole.

In FIGS. 3(*a*) and 4(*a*) a regular decrease in the volume of drilling mud in the mud tank at the surface, from approximately 9 $m^3$ to 8 $m^3$ may be noted between 24,000 seconds and 26,200 seconds (FIG. 3(*a*)), corresponding to a drill bit depth of between 950 m and 670 m (FIG. 4(*a*)). This decrease simply corresponds to the regular shortening of the drill string length in the bore hole due to the pipes being removed. This decrease in material is balanced by an equivalent volume of drilling mud, which may be translated by a regular lowering of the level of drilling mud in the mud tank. To implement this invention, it is not necessary to calculate the volume of the drill string withdrawn from the bore hole, but rather follow the decline of the curve in FIG. 3(*a*) or 4(*a*) to detect an increase with respect to the usual decrease; this increase indicates the influx of formation fluid into the bore hole.

In FIGS. 3(*a*) and 4(*a*) two successive influxes A and B can be observed. These influxes are correlated with recordings of force or weight P at the hook (FIGS. 3(*b*) and 4(*b*)). An increase in weight dP is clearly highlighted, indicated by C and D, with respect to the regular decrease in weight as shown by the straight line E. This regular decrease in weight, easily seen on the recording with respect to depth (FIG. 4), is due to the decrease in length of the drill string suspended by the hook, as the pipes are removed at the surface. In FIG. 3(*b*), the events C and D can be seen as consisting of two peaks each. This is in fact because to the increase in weight was not expected and the rate of lifting the drill string was not smooth, but rather very stongly "braked" at a given moment (for t=26,450 and t=27,100). To determine the increase in weight dP, the average value of the maximum weight P may, for example, be taken as there is a lot of noise associated with the recording as seen in FIGS. 3 and 4. In these figures, the increase in weight dP equals approximately 240 kN. The change in hydrostatic pressure dp at the drill bit depth being considered is easily determined by dividing the value dP by the drill bit's cross-sectional area S. Knowing dp, the formation's pore pressure is estimated from the drilling mud's hydrostatic pressure at the drill bit's depth.

We claim:

1. A method for estimating pore pressure in an underground formation being drilled with a drill string to form a borehole, said drill string comprising a plurality of drill pipes connected together with a drill bit at the lower end thereof, and with a drilling fluid being circulated through the drill pipe and borehole, the method comprising the steps of:

a) monitoring the value of a first parameter to detect an influx of fluid from the formation into the borehole;

b) monitoring the value of a second parameter indicative of the weight of the drill string while the drill bit is generally adjacent to the formation;

c) monitoring any changes in the value of the second parameter while the drill string is being raised to the surface;

d) correlating the first and second parameters and determining the change in value of the second parameter; and e) estimating the pore pressure of the formation from the determined change in value of the second parameter.

2. A method as claimed in claim 1, wherein changes in the first and second parameters are monitored during the removal or addition of more than one drill pipe to the drill string.

3. A method as claimed in claim 1, wherein the pore pressure is estimated from more than one retrieval of the drill string.

4. A method as claimed in claim 1, wherein the first parameter is the flow rate of drilling fluid leaving the bore hole.

5. A method as claimed in claim 1, wherein the drilling fluid is mud stored at the surface in a mud tank, the first parameter being a measure of the level of mud in the tank.

6. A method as claimed in claim 5, further comprising the step of correcting the first parameter to account for the volume of the drill string withdrawn from the borehole.

7. A method as claimed in claim 1, wherein the second parameter is the apparent weight P of the drill string.

8. A method as claimed in claim 7, wherein the apparatus weight is measured during drilling when the drill bit is not in contact with the bottom of the bore hole and is compared with the apparent weight at the same depth when retrieving the drill string.

9. A method as claimed in claim 1, wherein the change in the second parameter is determined for the piston effect when retrieving the drill string from a given depth.

10. A method as claimed in claim 9, wherein the hydrostatic pressure of the mud is calculated at said given depth.

11. A method as claimed in claim 1, wherein advancement of the drill bit during drilling is measured and correlated with values of the first and second parameters.

* * * * *